United States Patent [19]

Stritzl

[11] Patent Number: 4,620,719

[45] Date of Patent: Nov. 4, 1986

[54] APPARATUS FOR ADJUSTING THE LONGITUDINAL POSITION OF A BINDING PART ON A SKI

[75] Inventor: Karl Stritzl, Vienna, Austria

[73] Assignee: TMC Corporation, Baar, Switzerland

[21] Appl. No.: 583,454

[22] Filed: Feb. 24, 1984

[30] Foreign Application Priority Data

Mar. 4, 1983 [AT] Austria ..... 774/83

[51] Int. Cl.[4] ..... A63C 9/18

[52] U.S. Cl. ..... 280/633

[58] Field of Search ..... 280/626, 633, 636

[56] References Cited

U.S. PATENT DOCUMENTS 4,157,193 6/1979 Beyl ..... 280/633
4,589,674 5/1986 Krob ..... 280/633

FOREIGN PATENT DOCUMENTS 338674 12/1977 Austria .
3015478 4/1980 Fed. Rep. of Germany .
2451756 10/1980 France .
556674 12/1974 Switzerland .

*Primary Examiner*—John J. Love
*Assistant Examiner*—Richard Camby
*Attorney, Agent, or Firm*—Flynn, Thiel, Boutell & Tanis

[57] ABSTRACT

An apparatus for facilitating adjustment of a ski binding part longitudinally of a ski includes a guide rail adapted to be secured to the ski, a guide plate movably supported on the guide rail and having the ski binding part thereon, a piston longitudinally movably supported on the guide rail and biased in one direction by a thrust spring, and a locking mechanism for releasably holding the piston in various longitudinal positions relative to the guide rail. The locking mechanism includes a U-shaped locking element which has a bight and two generally upright legs and which is pivotally supported on the guide plate for movement between a locking position and a release position. The locking element has teeth on the bight thereof which engage teeth on the guide rail in the locking position, and one of the legs of the locking element slidably engages surfaces on a projection on the piston in a manner yieldably resisting movement of the locking element away from its release position.

18 Claims, 3 Drawing Figures

APPARATUS FOR ADJUSTING THE LONGITUDINAL POSITION OF A BINDING PART ON A SKI

FIELD OF THE INVENTION

The invention relates to an apparatus which facilitates longitudinal adjustment of a ski binding part on a ski and, more particularly, to such an apparatus which includes a guide rail which can be secured on the ski and to which a guide plate of the ski binding part which is movably supported on the guide rail can be releasably locked in various positions by a locking element, the locking element having an upwardly open U-shaped configuration with a web which connects two legs, the web having locking teeth which can engage teeth provided on the guide rail, one leg being adapted for operating the locking element, and the other leg being biased by a piston which is biased by at least one thrust spring which is supported on the guide plate.

BACKGROUND OF THE INVENTION

Such an apparatus for the longitudinal adjustment of a ski binding part is illustrated for example in FIGS. 10 to 14 of German Offenlegungsschrift No. 30 15 478. In this design, the guide rail is provided with perforations, into which engage downward projections of the locking element, which is urged toward the guide rail under the influence of the thrust springs. This is caused by sloped surfaces on the locking element which, when a ski shoe is not inserted into the skibinding part, engage corresponding sloped surfaces on the housing of the ski binding part. To release the locking engagement of locking element and guide rail, one leg of the approximately U-shaped locking element is lifted by means of an operating tool, which causes the projections of the locking element to come free from the perforations in the guide rail so that the ski binding part can be moved along the guide rail. However, this design has the disadvantage that the ski binding part must be constructed specially and that, during the adjusting operation, the locking element must constantly be held up manually, so that single-handed operation thereof is not possible.

A further apparatus for facilitating longitudinal adjustment of a ski binding part is disclosed in French Publication No. 24 51 756. In this apparatus, the locking element is also under the influence of a thrust spring and has projections which engage perforations in the guide rail. The locking element is, when no ski shoe is inserted, supported on a downwardly projecting part of the housing of the ski binding part. It is furthermore constantly coupled with a wire bar, the upper end area of which is stored in a recess of the ski binding part. For the longitudinal adjustment of the ski binding part, a special tool in the form of a screwdriver with two grooves arranged on the blade and directed toward its axis is required and can be placed under the wire bar, the locking element being lifted by pivoting the screwdriver 90°. The ski binding part can subsequently be moved along the guide rail. When the desired position of the ski binding part is reached, then the screwdriver is turned back 90° and thereafter pulled out from under the wire bar. The projections of the locking element then again engage, due to the urging of the thrust spring, the holes in the guide rail. However, this design has the disadvantages that the ski binding part must be constructed specially and that for its adjustment a special tool is needed.

A purpose of the invention is thus to provide an apparatus for facilitating the longitudinal adjustment of a ski binding part which does not have the disadvantages of conventional designs, which can be used in ski bindings of any construction, which is simple in structure and reliable in operation, and which can be operated with one hand and without any special tool.

SUMMARY OF THE INVENTION

This purpose is attained by providing an apparatus of the type mentioned above in which the leg of the locking element associated with the piston, in a position of the ski binding part without an inserted shoe, is urged by the thrust springs toward fishplates on the guide plate which define bearing points for the locking element and in which such leg, in the lifted position of the locking element, is releasably locked on a surface of the piston.

Through these inventive measures it is assured that by a mere lifting of the locking element, for example manually or by means of a common screwdriver, the locking element swings up around the bearing points which are provided on the guide plate, which causes one leg of the locking element to be releasably locked on a surface of the spring-loaded piston. Then, the ski-binding part can easily be moved manually to a desired position.

To lock the leg of the locking element in the lifted position, it is provided inventively that the piston has two projections which are offset with respect to one another in a vertical direction, the leg of the locking element which is associated with the piston engaging, in the lifted position of the locking element, the underside of the upper projection on the piston. Since for this only minor structural changes of the piston are needed, the apparatus can be built very simply.

This embodiment of the invention is particularly advantageous when the projection on the piston which cooperates with the leg of the locking element has on its underside a locking surface which is inclined in the longitudinal direction of the guide plate. This assures a secure releasable locking of the locking element in its lifted position.

A further inventive development provides that the upper projection on the piston is shorter than the lower projection and that the leg of the locking element which is associated with the piston has at its upper end a bent section which points in the direction of the piston, both projections on the piston engaging, under the urging of the thrust springs, the leg of the locking element. Thus, only a small lifting angle of the locking element is needed to effect unlocking and also a smaller spring force must be overcome during locking.

For the pivotal support of the locking element on the fishplates of the guide plate, which fishplates define the bearing points, according to a further characteristic of the invention the lower end of the leg of the locking element which is associated with the piston has laterally spaced support surfaces which are supported on support shoulders bent from the fishplates.

A further characteristic of the invention includes the two support surfaces being curved and defining the pivot axis of the locking element, and includes the locking surface on the upper projection of the piston being rounded and extending approximately concentrically with respect to the pivot axis of the locking element.

Through this, the leg of the locking element slides, during locking and unlocking, along the locking surface of the projection of the piston, so that even after repeated locking and unlocking the material wear is low.

BRIEF DESCRIPTION OF THE DRAWINGS

Further characteristics, advantages and details of the invention will now be described in connection with the drawings, which illustrate one exemplary embodiment of an apparatus which embodies the invention and is adapted to facilitate longitudinal adjustment of a ski binding part.

In the drawings.

DETAILED DESCRIPTION

Figure 1:
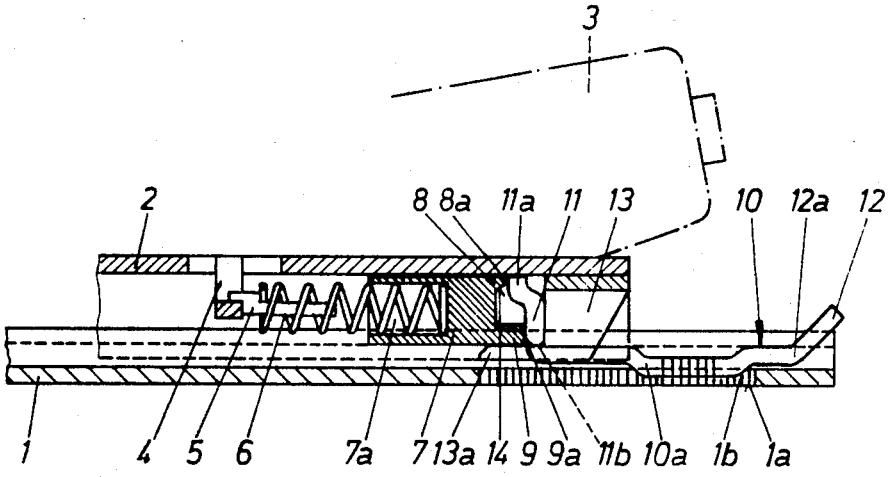
FIG. 1 is a sectional side view of an apparatus which embodies the invention and is adapted to facilitate longitudinal adjustment of a ski binding part, the adjusting apparatus being shown in an engaged condition when no ski shoe is inserted in the binding.
Figure 3:
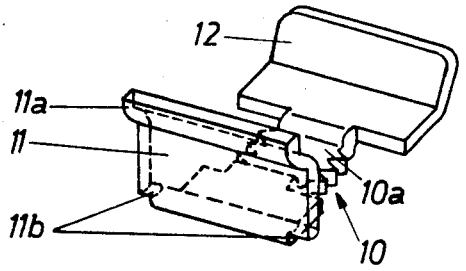
FIG. 3 is a perspective view of a locking element which is a component of the apparatus of FIG. 1.
Figure 2:
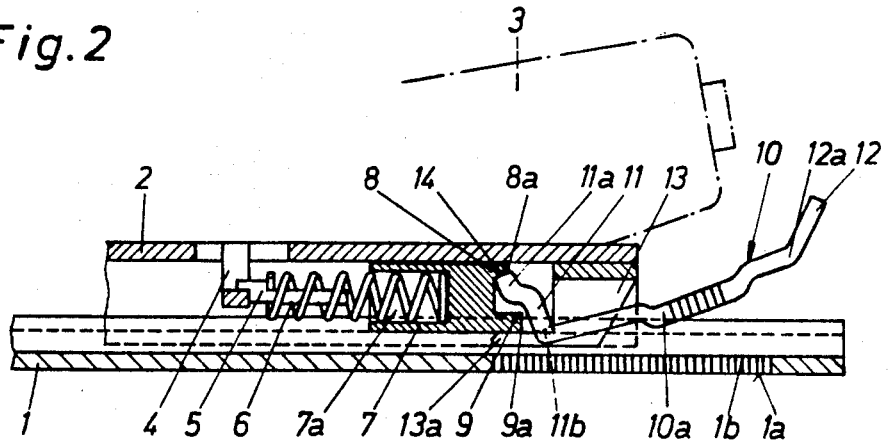
FIG. 2 is a sectional side view similar to FIG. 1 showing the adjusting apparatus in a disengaged condition.

As can be seen from FIGS. 1 and 2, guide rail 1 which is adapted to be secured on a not illustrated ski is provided, the lateral edge portions of which are bent twice in a conventional manner and thus form guideways for supporting a guide plate 2. The guide rail 1 has furthermore an elongate recess or slot 1*a* in the center thereof which extends longitudinally and which has on both sides thereof a plurality of teeth 1*b*. A skibinding part 3, for example a conventional heel holder, is fixedly secured on the guide plate 2. The guide plate 2, which is supported for movement longitudinally of the ski on the guide rail 1, carries on its underside a support shoulder 4, which projects toward the upper side of the ski and has secured thereon the cross part or bight of a U-shaped guide element 5 for two thrust springs 6 which are helical compression springs. Each spring 6 encircles a respective leg of the guide element 5 and has an end disposed against the bight thereof. A piston 7 is furthermore provided, which piston 7 preferably is made of plastic, is generally rectangular, is supported for movement longitudinally of the ski, and has two blind holes 7*a* which each receive an end of a respective thrust spring 6 and which each extend in the longitudinal direction of the ski. Two projections 8 and 9 which extend transversely with respect to the longitudinal direction of the ski are provided at the closed end of the piston 7. The projection 8 is arranged at the upper edge of the end of the piston 7, and the projection 9 is arranged at the lower edge of the end of the piston 7 and is, in the longitudinal direction of the ski, longer than the projection 8. The projections 8 and 9 each have a respective bearing surface 8*a* or 9*a* thereon for slidably engaging a locking element 10, which bearing surfaces extend transversely of and are perpendicular to the upper side of the ski.

The locking element 10 is, viewed in a side view, approximately U-shaped, and thus has two legs 11 and 12 and a bight or center web 10*a*. The center web 10*a* of the locking element 10 carries locking teeth on each side thereof which are designed for engaging the teeth 1*b* on the guide rail. The leg 11 of the locking element 10 is wider than the center web 10*a*, through which two support surfaces 11*b* are defined at the lower end of the leg 11, by means of which support surfaces 11*b* the locking element 10 can be supported on support shoulders 13*a* of two fishplates 13 which are provided at laterally spaced locations on the guide plate 2. The support surfaces 11*b* are convex and arcuate in the illustrated embodiment. A bent section 11*a* is defined at the free end of the leg 11 by two bends therein, on which bent section 11*a* is slidably supported the bearing surface 8*a* on the projection 8 of the spring-biased piston 7. The bearing surface 9*a* of the projection 9 engages the lower portion of the leg 11. The leg 12, which lies opposite the leg 11, is provided with a bent section 12*a*, which permits movement of the locking element 10 manually or by means of an operating tool, for example a conventional and not illustrated screwdriver.

The shoulders 13*a* on the two fishplates 13 of the guide plate 2 define, when no ski shoe is inserted into the heel holder 3 (namely when the guide plate 2 is in its forwardmost position relative to the piston 7 and the locking element 10 engages the fishplates 13), a bearing point for pivotal movement of the locking element 10. If now the locking element 10 is lifted by means of a screwdriver, the blade of which is introduced between the bent section 12*a* of the leg 12 and the guide rail 1, then the locking element 10 pivots about the just-described bearing points which are defined by the support shoulders 13*a*. The bent section 11*a* of the leg 11 moves the piston 7 leftwardly relative to the guide plate 2 against the force of the thrust springs 6. During this lifting movement of the locking element 10, the upper end of the leg 11 slides along the bearing surface 8*a* of the projection 8 and moves onto an inclined locking surface 14 which is the undersurface of the projection 8. The locking surface 14 extends the entire width of the piston 7 and preferably, viewed in a side view, has a concave arcuate shape, the centerpoint of such curvature being approximately coincident with the location at which the support surfaces 11*b* of the locking element 10 are supported on the support shoulders 13*a*. The locking element 10 is now maintained in its lifted and disengaged position (FIG. 2) by its leg 11, which urges the piston 7 against the underside of the guide plate 2. The binding 3 and guide plate 2 can now be moved along the ski-fixed guide rail 1 to a desired position, without any need to continuously hold the locking element 11 manually in its lifted position. When the desired position of the heel holder 3 on the ski-fixed guide rail 1 is reached, then manually exerting a small downward force on the leg 12 of the locking element 10 will be sufficient to move it so that its teeth again engage the teeth 1*b* on the guide rail 1.

The invention is not limited to the illustrated exemplary embodiment. Further variations and modifications, including the rearrangement of parts, are conceivable without leaving the scope of protection. Thus, it is possible to design the leg 11 of the locking element, which when the ski shoe is not inserted is supported on the fishplates of the guide plate, without a bent section and thus as a straight leg. This, however, requires a reduction of the vertical dimension of the bearing surface on the upper projection of the piston to assure a constant angle of pivotal movement during the lifting of the locking element to effect unlocking. Furthermore, it is possible to omit the inclined locking surface from the upper projection of the piston, which then causes an edge of the projection to cooperate with the upper end of the associated leg of the locking element.

The embodiments of the invention in which an exclusive property or privilege is claimed are defined as follows:

1. An apparatus for facilitating longitudinal adjustment of a ski binding part relative to a ski, comprising a guide rail which is adapted to be secured on the ski and a guide plate which is movably supported on the guide rail and can be releasably locked in various longitudinal positions by a locking element, wherein the locking element, in a side view, is generally U-shaped and has a web and two legs, the web connecting the two legs and having locking teeth which can engage teeth provided on the guide rail, a first of the legs being adapted for moving the locking element between a locking position and a lifted position to respectively effect engagement and disengagement of the teeth thereon with the teeth on the guide rail, and a second of the legs being biased by a piston which is movable relative to the guide plate and is biased by a first end of at least one thrust spring which has a second end supported on the guide plate, the piston having an upper projection which engages the second leg of the locking element, wherein the locking element is held in the locking position by the action of a structural part of the binding part even when no ski shoe is clamped in the binding part, wherein the upper projection of the piston has on its underside a locking surface on which, in the lifted position of the locking element, the locking element is releasably held, the second leg of the locking element engaging the locking surface in the lifted position of the locking element, wherein the piston has a lower projection below the upper projection and the upper projection of the piston is shorter than the lower projection, wherein the second leg of the locking element which is associated with the piston carries at its upper end a bent section which is offset in the direction of the piston, and wherein both projections of the piston, under the urging of the thrust spring, engage the second leg of the locking element in the locking position.

2. The apparatus according to claim 1, wherein the second leg of the locking element, when no ski shoe is clamped in the binding part, engages a bearing surface on the lower projection.

3. An apparatus for facilitating longitudinal adjustment of a ski binding part relative to a ski, comprising a guide rail which is adapted to be secured on the ski and a guide plate which is movably supported on the guide rail and can be releasably locked in various longitudinal positions by a locking element, wherein the locking element, in a side view, is generally U-shaped and has a web and two legs, the web connecting the two legs and having locking teeth which can engage teeth provided on the guide rail, a first of the legs being adapted for moving the locking element between a locking position and a lifted position to respectively effect engagement and disengagement of the teeth thereon with the teeth on the guide rail, and a second of the legs being biased by a piston which is movable relative to the guide plate and is biased by a first end of at least one thrust spring which has a second end supported on the guide plate, the piston having an upper projection which engages the second leg of the locking element, wherein the locking element is held in the locking position by the action of a structural part of the binding part even when no ski shoe is clamped in the binding part, wherein the upper projection of the piston has on its underside a locking surface on which, in the lifted position of the locking element, the locking element is releasably held, the second leg of the locking element engaging the locking surface in the lifted position of the locking element, wherein the guide plate has on an underside thereof laterally spaced fishplates which each have an upwardly facing support shoulder at a location spaced below the guide plate, wherein the lower end of the second leg of the locking element which is associated with the piston has laterally spaced, downwardly facing support surfaces which are each supported on a respective one of the support shoulders provided on the fishplates of the guide plate.

4. An apparatus for facilitating longitudinal adjustment of a ski binding part relative to a ski, comprising a guide rail which is adapted to be secured on the ski and a guide plate which is movably supported on the guide rail and can be releasably locked in various longitudinal positions by a locking element, wherein the locking element, in a side view, is generally U-shaped and has a web and two legs, the web connecting the two legs and having locking teeth which can engage teeth provided on the guide rail, a first of the legs being adapted for moving the locking element between a locking position and a lifted position to respectively effect engagement and disengagement of the teeth thereof with the teeth on the guide rail, and a second of the legs being biased by a piston which is movable relative to the guide plate and is biased by a first end of at least one thrust spring which has a second end supported on the guide plate, the piston having an upper projection which engages the second leg of the locking element, wherein the locking element is held in the locking position by the action of a structural part of the binding part even when no ski shoe is clamped in the binding part, wherein the upper projection of the piston has on its underside a locking surface on which, in the lifted position of the locking element, the locking element is releasably held, the second leg of the locking element engaging the locking surface in the lifted position of the locking element, wherein the locking surface on the upper projection is inclined in a direction longitudinally of the guide plate, wherein the guide plate has on an underside thereof two laterally spaced plates which each have an upwardly facing support shoulder at a location spaced below the guide plate, wherein the second leg of the locking element has at a lower end thereof two laterally spaced, downwardly facing support surfaces which each engage a respective one of the support shoulders, wherein the two support surfaces are arcuate and define a pivot axis about which the locking element pivots between the locking and lifted positions, and wherein the locking surface on the upper projection of the piston is rounded and extends concentrically with respect to the pivot axis of the locking element.

5. An apparatus for longitudinally adjusting the position of a ski-binding part on a ski, comprising a guide rail which is adapted to be secured on the ski, a guide plate which can support the ski-binding part and is movably supported on said guide rail, a locking element which can releasably lock said guide plate in various positions relative to said guide rail and which, in a side view, has an upwardly open U-shaped design which includes a web and first and second legs which project upwardly from opposite ends of said web, said web having locking teeth which can engage teeth provided on said guide rail and said locking element being supported on said guide plate for movement between a locked position and an unlocked position in which said teeth thereon are respectively engaged with and spaced from said teeth on said guide rail, manual movement of said first leg causing movement of said locking element, said second leg being biased by a piston which is movably supported on said guide plate and is in turn biased by a first end of a thrust spring which has a second end supported on said guide plate, said piston having an upper projection which projects outwardly therefrom in a direction toward said locking element and which has a first surface engaging a portion of said locking element in said locked position and also has a locking surface which engages a portion of said locking element in said unlocked position wherein said portion of said locking element moves from said first surface to said locking surface when said locking element is moved from said locked position to said unlocked position so as to releasably hold said locking element in said unlocked position.

6. The apparatus according to claim 5, wherein said portion of said locking element which engages said locking surface on said upper projection of said piston is an upper end of said second leg of said locking element.

7. The apparatus according to claim 5, wherein said piston has at a location spaced below said upper projection a lower projection which projects toward said locking element and which engages a portion of said second leg of said locking element adjacent said web when said locking element is in said locked position.

8. The apparatus according to claim 5, wherein said locking surface on said upper projection is inclined to extend away from said locking element and toward said guide plate.

9. The apparatus according to claim 7, wherein said upper projection of said piston is shorter than said lower projection, wherein said second leg of said locking element has a bend between an upper portion and a lower portion of said second leg, said upper portion of said second leg being closer to said piston than said lower portion thereof, and wherein said upper and lower projections of said piston, under the urging of said thrust spring, respectively engage said upper and lower portions of said second leg of said locking element when said locking element is in said locked position.

10. The apparatus according to claim 5, wherein a lower end of said second leg of said locking element has two laterally spaced support surfaces thereon, and wherein said guide plate has on an underside thereof two laterally spaced, downwardly projecting plates which each have at a location spaced below said guide plate an upwardly facing support shoulder which engages a respective one of said support surfaces on said second leg of said locking element.

11. The apparatus according to claim 10, wherein said support surfaces are arcuately curved, wherein said locking element is supported for pivotal movement between said locked and unlocked positions about a pivot axis defined by engagement of said support surfaces on said locking element with said support shoulders of said plates on said guide plate, and wherein said locking surface on said upper projection of said piston is rounded so as to extend approximately concentrically with respect to said pivot axis of said locking element.

12. A ski binding apparatus adapted to releasably hold a ski boot on a ski, comprising: a guide rail adapted to be fixedly mounted on the ski and having thereon a row of teeth which extends in a first direction longitudinally of the ski; a guide member supported on said guide rail for longitudinal movement therealong, said guide member being adapted to have a ski bindng part mounted thereon; a locking element which has a tooth thereon; means supporting said locking element and said guide member for relative longitudinal movement, and means supporting said locking element for pivotal movement about a transverse horizontal pivot axis between first and second positions in which said tooth is respectively engaging and spaced from said row of teeth on said guide rail; resilient means for yieldably urging longitudinal movement of said locking element in said first direction relative to said guide member; limit means for limiting movement of said locking element in said first direction under the urging of said resilient means; and holding means cooperable with said locking element in said second position for releasably holding said locking element against movement toward said first position, said holding means including a piston which is longitudinally movably supported on said guide member, movement of said piston toward said locking element being movement in said first direction, said resilient means including means for yieldably urging said piston in said first direction relative to said guide member, and said piston having thereon a projection which projects outwardly therefrom in said first direction toward said locking element, said projection having on an end thereof remote from said piston an end surface which faces in said first direction and having on an underside thereof a locking surface, said holding means further including said locking element having at a location vertically higher than said pivot axis a portion which respectively engages said end surface and said locking surface on said projection of said piston when said locking element is respectively in said first and second positions, pivotal movement of said locking element from said first position to said second position causing said portion thereof to move from said end surface to said locking surface on said projection while simultaneously moving said projection and said piston in a second direction opposite said first direction against the urging of said resilient means.

13. The apparatus according to claim 12, wherein said locking element includes a longitudinally extending web which has thereon said tooth of said locking element and includes a leg which extends upwardly from an end of said web nearest said piston, said pivot axis of said locking element being in the region of a lower end of said leg and said portion of said locking element being an upper end of said leg.

14. The apparatus according to claim 13, including two laterally spaced plates which are secured to and extend downwardly from an underside of said guide member, each said plate having a first portion which extends downwardly and a second portion which extends in said second direction from a lower end of said first portion and has an upwardly facing support shoulder on an upper side thereof, wherein said web is disposed between and has a lateral width less than the distance between said plates, wherein said leg of said locking element has a lateral width greater than the distance between said plates, has two laterally spaced, downwardly facing support surfaces at said lower end thereof which each engage a respective one of said support shoulders, engagement of said support surfaces and said support shoulders being substantially coincident with said pivot axis, and wherein said limit means includes laterally spaced portions of said leg of said locking element being engageable with said first portions of said plates.

15. The apparatus according to claim 14, wherein said piston has a further projection spaced below said first mentioned projection and projecting in said first direction toward said locking element, said further projection having an end remote from said piston which engages said lower portion of said leg or said locking element when said locking element is in said first position.

16. The apparatus according to claim 15, wherein said locking element includes a further leg which extends upwardly from an end of said web remote from said first-mentioned leg.

17. The apparatus according to claim 12, wherein said resilient means includes a helical compression spring which extends approximately in said first direction, which has a first end supported on said piston, and which has a second end supported on said guide member.

18. The apparatus according to claim 12, wherein said locking surface on said projection of said piston is arcuate and approximately concentric with said pivot axis of said locking element.

* * * * *